US007944272B2

(12) United States Patent
Nishi

(10) Patent No.: US 7,944,272 B2
(45) Date of Patent: May 17, 2011

(54) CONSTANT CURRENT CIRCUIT

(75) Inventor: Tomoaki Nishi, Nagaoka (JP)

(73) Assignees: Sanyo Electric Co., Ltd., Osaka (JP); Sanyo Semiconductor Co., Ltd., Gunma (JP)

( * ) Notice: Subject to any disclaimer, the term of this patent is extended or adjusted under 35 U.S.C. 154(b) by 0 days.

(21) Appl. No.: 12/568,916

(22) Filed: Sep. 29, 2009

(65) Prior Publication Data

US 2010/0079198 A1 Apr. 1, 2010

(30) Foreign Application Priority Data

Sep. 29, 2008 (JP) ..... 2008-251470

(51) Int. Cl.
*G05F 1/10* (2006.01)

(52) U.S. Cl. ..... 327/513; 327/539; 323/313

(58) Field of Classification Search ..... 327/512, 327/513, 539; 323/313
See application file for complete search history.

(56) References Cited

U.S. PATENT DOCUMENTS

| | | | | |
|---|---|---|---|---|
| 4,725,770 | A * | 2/1988 | Okutsu et al. | 323/313 |
| 5,610,547 | A * | 3/1997 | Koyama et al. | 327/350 |
| 6,316,990 | B1 * | 11/2001 | Tanizawa | 327/538 |
| 6,344,770 | B1 * | 2/2002 | Zha et al. | 327/539 |
| 6,690,228 | B1 * | 2/2004 | Chen et al. | 327/538 |
| 6,995,587 | B2 * | 2/2006 | Xi | 327/77 |
| 7,750,721 | B2 * | 7/2010 | Ilkov et al. | 327/513 |
| 2004/0095187 | A1 * | 5/2004 | Li | 327/539 |
| 2008/0238400 | A1 * | 10/2008 | Dobkin | 323/313 |
| 2009/0153125 | A1 * | 6/2009 | Arai | 323/313 |

FOREIGN PATENT DOCUMENTS

JP 08-339232 12/1996

* cited by examiner

*Primary Examiner* — Thomas J Hiltunen
(74) *Attorney, Agent, or Firm* — SoCal IP Law Group LLP; Steven C. Sereboff; John E. Gunther

(57) ABSTRACT

A constant-current circuit comprising: a temperature-compensation circuit to output a temperature-compensated first current; and a current-supply circuit to supply a second current to the temperature-compensation circuit, the temperature-compensation circuit including a voltage-multiplication circuit including a first transistor to generate a base-collector voltage obtained by multiplying a base-emitter voltage by a predetermined ratio, a second transistor identical in conductivity type and substantially equal in base-emitter voltage to the first transistor, a first resistor having two ends connected to a first-transistor collector and second-transistor base, respectively, and a second resistor having two ends connected to first and second-transistor emitters, respectively, the first current being output according to a second-transistor collector current, the second current being supplied to a connection point between a second-transistor base and the first resistor, to generate between both ends of the first resistor a voltage varying substantially in proportion to temperature.

4 Claims, 6 Drawing Sheets

CONSTANT CURRENT CIRCUIT

CROSS-REFERENCE TO RELATED APPLICATION

This application claims the benefit of priority to Japanese Patent Application No. 2008-251470, filed Sep. 29, 2008, of which full contents are incorporated herein by reference.

BACKGROUND OF THE INVENTION

1. Field of the Invention

The present invention relates to a constant current circuit.

2. Description of the Related Art

As a voltage source employed in a semiconductor integrated circuit or the like, there is known in general a voltage source including a bandgap circuit using a bandgap voltage of pn junction in a diode or transistor. For example, in FIGS. 1 to 4 in Japanese Patent Laid-Open Publication No. Hei8-339232, there is disclosed a reference voltage generation circuit (referred to as "a reference voltage circuit" in the Japanese Patent Laid-Open Publication No. Hei8-339232), in which a reference voltage is generated utilizing a difference between base-emitter voltages of a pair of transistors, a voltage between both ends of a resistor (hereinafter, referred to as "a voltage across a resistor") having a positive temperature coefficient is offset by a forward drop voltage of the pn junction having a negative temperature coefficient, and a reference voltage without a temperature coefficient is output.

Here, there is shown in FIG. 6 a reference voltage generation circuit having a configuration similar to that shown in FIG. 3 of the Japanese Patent Laid-Open Publication No. Hei8-339232. In a reference voltage generation circuit 21*a* of FIG. 6, assuming that a voltage across a resistor R9 is VR9 and a forward drop voltage of a diode D1 is VD, an output voltage Vout is:

$$Vout = VR9 + VD$$

$$= (R9/R5)\cdot(k\cdot T/q)\cdot\ln(N) + VD$$

and thus, the temperature coefficient can be made 0 by making a positive temperature coefficient (R9/R5)·(k·T/q)·ln(N) of VR9 equal to an absolute value of the negative temperature coefficient of VD.

In this way, a resistance value, a ratio between their respective emitter areas of transistors, and the like are set to offset the temperature coefficient in the bandgap circuit, so that a temperature compensated reference voltage can be output.

However, when the current source is required as a power supply of a semiconductor integrated circuit or the like, even if a current I5 flowing through the resistor R9 of the reference voltage generation circuit 21*a* in FIG. 6 is output as an output current, the temperature coefficient cannot be made 0. For example, as shown in FIG. 7, in a current supply circuit 2*a* with such a configuration that the current I5 in FIG. 6 is supplied to an outside load (not shown), an output current Iout is:

$$Iout=(1/R5)\cdot(k\cdot T/q)\cdot\ln(N)$$

and it has a positive temperature coefficient.

Thus, a constant current independent of temperature cannot be output.

SUMMARY OF THE INVENTION

A constant current circuit according to an aspect of the present invention, comprises: a temperature compensation circuit configured to output a first current which is temperature-compensated; and a current supply circuit configured to supply a second current to the temperature compensation circuit, the temperature compensation circuit including a voltage multiplication circuit including a first transistor configured to generate a base-collector voltage obtained by multiplying a base-emitter voltage by a predetermined ratio, a second transistor identical in conductivity type and substantially equal in base-emitter voltage to the first transistor, a first resistor having one end connected to a collector of the first transistor and the other end connected to a base of the second transistor, and a second resistor having one end connected to an emitter of the first transistor and the other end connected to an emitter of the second transistor, the first current being output according to a collector current of the second transistor, the second current being supplied to a connection point between a base of the second transistor and the first resistor, to generate between both ends of the first resistor a voltage varying substantially in proportion to temperature.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

First Embodiment

There will hereinafter be described a configuration of a constant current circuit according to a first embodiment of the present invention referring to FIG. 1.

Figure 1:
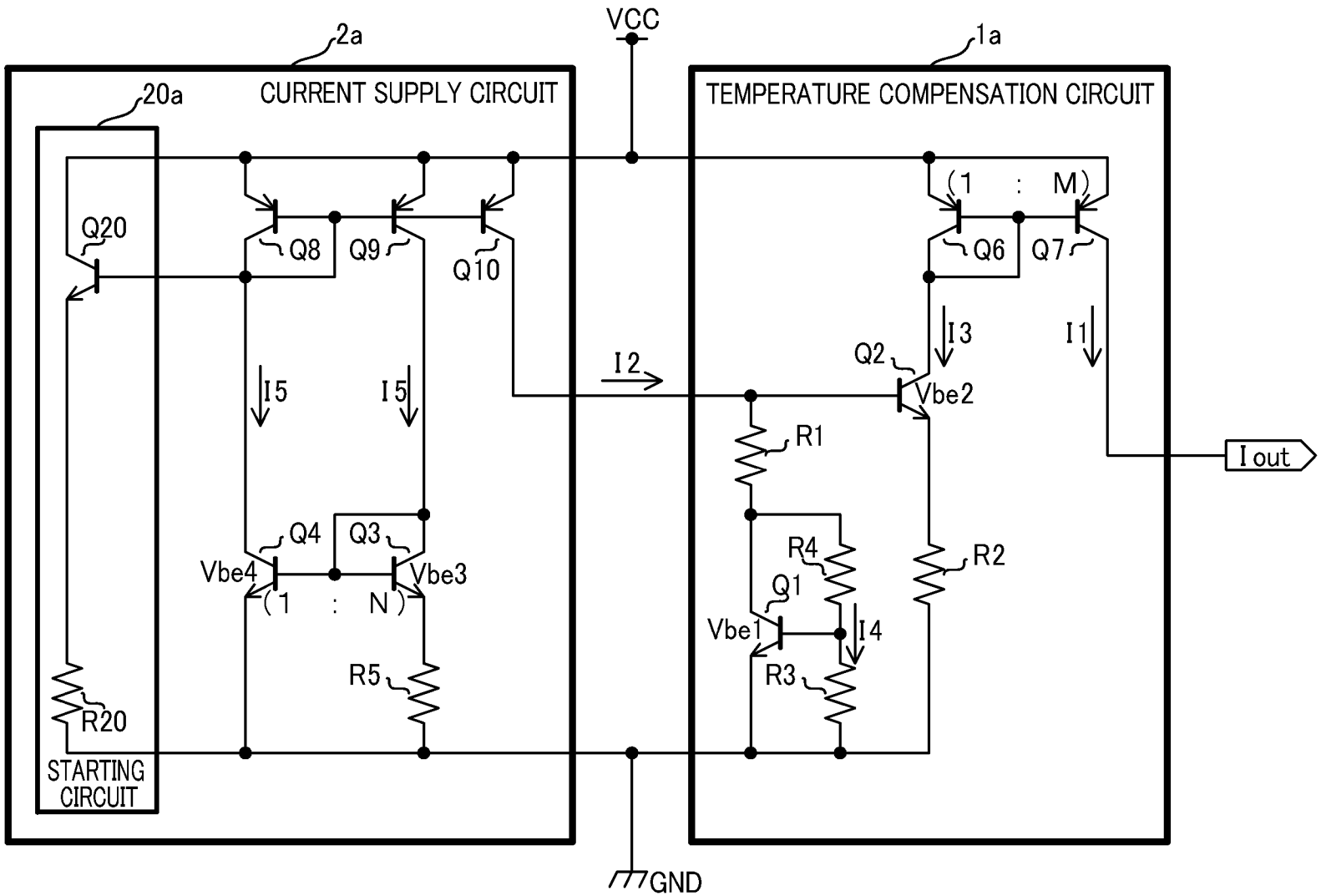
FIG. 1 is a circuit block diagram illustrating a configuration of a constant current circuit according to a first embodiment of the present invention.

The constant current circuit shown in FIG. 1 includes a current supply circuit 2*a* and a temperature compensation circuit 1*a*.

The current supply circuit 2*a* includes: transistors Q3, Q4, which are NPN bipolar transistors; transistors Q8, Q9, Q10, which are PNP bipolar transistors; a resistor R5; and a starting circuit 20*a* including a transistor Q20, which is an NPN bipolar transistor, and a resistor R20, for example. The diode-connected transistor Q8 and the fourth transistor Q4 have collectors thereof connected to each other, and emitters connected to a power-supply potential VCC and a ground potential, respectively. The transistor Q9, which constitutes a current mirror circuit together with the transistor Q8, and the diode-connected third transistor Q3 have collectors thereof connected to each other, and the emitter of the transistor Q9 is connected to the power-supply potential VCC and the emitter of the transistor Q3 is connected to the ground potential through the fifth resistor R5, respectively. The transistors Q3 and Q4 have their respective bases connected to each other, and N is a value of a ratio between their respective emitter areas. Moreover, the transistor Q10, which constitutes a current mirror circuit together with the transistor Q8, has an emitter connected to the power-supply potential VCC, and a collector current is output from the current supply circuit 2*a* as a second current I2. A transistor Q20 of the starting circuit 20*a* has a collector connected to the power-supply potential VCC, an emitter connected to the ground potential through the resistor R20, and a base connected to the base of the transistor Q8, respectively.

The temperature compensation circuit 1*a* includes: transistors Q1, Q2, which are NPN bipolar transistors; transistors Q6, Q7, which are PNP bipolar transistors; and resistors R1, R2, R3, R4, for example, according to an embodiment of the present invention. The first transistor Q1 has a base and an emitter connected to each other via the third resistor R3 and the base and a collector connected to each other by the fourth resistor R4, respectively, and the emitter is connected to the ground potential and the collector is connected to the output of the current supply circuit 2*a* through the first resistor R1, respectively. The diode-connected transistor Q6 and the second transistor Q2 have collectors connected to each other, the emitter of the transistor Q6 is connected to the power-supply potential VCC, the emitter of the transistor Q2 is connected to the ground potential through the second resistor R2, and the base of the transistor Q2 is connected to the output of the current supply circuit 2*a*, respectively. The transistor Q7, constitutes a current mirror circuit together with the transistor Q6, has an emitter connected to the power-supply potential VCC and a collector current is output from the temperature compensation circuit 1*a* as a first current I1. The transistors Q7 and Q6 have a value of a ratio M between their respective emitter areas.

Subsequently, there will be described an operation of the constant current circuit according to an embodiment of the present invention. It will hereinafter be assumed that a base current of each transistor in the current supply circuit 2*a* and the temperature compensation circuit 1*a* is sufficiently smaller than the currents I1 to I5.

In the current supply circuit 2*a*, assuming that a base-emitter voltage of the transistor Q3 and a base-emitter voltage of the transistor Q4 are Vbe3 and Vbe4, respectively, the voltage between both ends of the resistor (hereinafter, referred to as "the voltage across the resistor") R5 is Vbe4−Vbe3, and thus, the collector current I5 of the transistors Q8 to Q10 constituting the current mirror circuit can be expressed as:

$$I5=(Vbe4-Vbe3)/R5$$

Assuming that the emitter currents of the transistors Q3 and Q4 are Ie3 and Ie4, respectively, the base-emitter voltage Vbe3 and the base-emitter voltage Vbe4 are known to be given by:

$$Vbe3=(k\cdot T/q)\cdot\ln(Ie3/Is),$$

$$Vbe4=(k\cdot T/q)\cdot\ln(Ie4/Is)$$

Here, k (≈1.38×10$^{-23}$ J/K) is Boltzmann's constant, T is an absolute temperature, q (≈1.60×10$^{-19}$ C) is an elementary charge, and Is is a saturation current of the transistors Q3 and Q4. Moreover, as mentioned above, since N is the value of the ratio between the respective emitter areas of the transistors Q3 and Q4, a relationship between the emitter currents Ie3 and Ie4 can be expressed as:

$$Ie4=N\cdot Ie3$$

Therefore, the output current I2 of the current supply circuit 2*a* can be given by:

$$\begin{aligned} I2 &= I5 \\ &= (1/R5)\cdot(k\cdot T/q)\cdot\ln(N) \\ &= (a/R5)\cdot T \end{aligned}$$

using a constant a independent of temperature T, which is:

$$a=(k/q)\cdot\ln(N)$$

In an embodiment according to the present invention, the output current I2 of the current supply circuit 2*a* is a source current.

In the current supply circuit 2*a*, the transistors Q3, Q4, Q8 and Q9 are connected in a loop state, and bases of the transistors are connected in the loop. Thus, a bias of each transistor is unfixed at power-on, and a current may not flow through any of the transistors depending on a manner of a power-on, and thus, the current supply circuit 2*a* may not be started. In an embodiment according to the present invention, since base currents of the transistors Q8 and Q9 flows toward the base of the transistor Q20 of the starting circuit 20*a*, the current supply circuit 2*a* can be normally started.

In the temperature compensation circuit 1*a*, assuming that the voltages across the resistors R1 and R4 are VR1 and VR4, respectively, and a base-emitter voltage Vbe1 of the transistor Q1 is substantially equal to a base-emitter voltage Vbe2 of the transistor Q2, the voltage VR2 across the resistor R2 can be expressed as:

$$\begin{aligned} VR2 &= VR1 + VR4 + Vbe1 - Vbe2 \\ &= VR1 + VR4 \end{aligned}$$

Moreover, assuming that the current flowing through the resistors R4 and R3 is I4, the voltages across VR1 and VR4 can respectively be expressed, using a value b1 (=R1/R5) of a resistance value ratio between the resistors R1 and R5 and a value b2 (=R4/R3) of a resistance value ratio between the resistors R4 and R3, by following equations:

$$\begin{aligned} VR1 &= I2\cdot R1 \\ &= a\cdot(R1/R5)\cdot T \\ &= a\cdot b1\cdot T, \end{aligned}$$

$$\begin{aligned} VR4 &= I4\cdot R4 \\ &= (R4/R3)\cdot Vbe1 \\ &= b2\cdot Vbe1 \end{aligned}$$

Here, assuming that the resistors R1 and R5 have a substantially equal temperature coefficient c1, resistance values at the temperature T are respectively given by:

$$R1=Rref1\cdot(1+c1\cdot T),$$

$$R5=Rref5\cdot(1+c1\cdot T)$$

and the value b1 of the resistance value ratio is a constant independent of the temperature T. Therefore, the voltage across VR1 is a voltage varying substantially in proportion to the temperature T. Similarly, assuming that the resistors R4 and R3 have a substantially equal temperature coefficient, the value b2 of the resistance value ratio is also a constant independent of the temperature T. Therefore, the above voltage VR4, that is, a base-collector voltage of the transistor Q1 is a voltage obtained by multiplying the base-emitter voltage Vbe1 by a certain ratio, independently of the temperature. Moreover, assuming that a bandgap voltage at 0 K of the pn junction of the transistor Q1 is Vbg1 and a temperature coefficient is −d1, the base-emitter voltage Vbe1 is given by:

$$Vbe1=Vbg1-d1\cdot T$$

Therefore, the voltage VR2 can be expressed, using constants A1 and B1 independent of the temperature T given by:

$$A1=b2\cdot Vbg1,$$

$$B1=a\cdot b1b2\cdot d1$$

as a linear function of the temperature T that can be expressed as:

$$\begin{aligned} VR2 &= b2\cdot Vbg1+(a\cdot b1-b2\cdot d1)\cdot T \\ &= A1+B1\cdot T \end{aligned}$$

On the other hand, since a collector current I3 of the transistor Q6 flows through the resistor R2, the collector current I3 is:

$$I3=VR2/R2$$

Moreover, assuming that the temperature coefficient of the resistor R2 is c2, a resistance value at the temperature T is given by:

$$R2=Rref2\cdot(1+c2\cdot T)$$

Here, by differentiating the collector current I3 with respect to the temperature T, the following expressions can be obtained:

$$\begin{aligned} \partial I3/\partial T &= (I/R2^2)\cdot(R2\cdot B1-Rref2\cdot c2\cdot VR2) \\ &= (Rref2/R2^2)\cdot(B1-c2\cdot A1) \end{aligned}$$

Therefore, the collector current I3 becomes constant independently of the temperature under such a condition as:

$$\begin{aligned} B1-c2\cdot A1 &= a\cdot b1(d1+c2\cdot Vbg1)\cdot b2 \\ &= 0 \end{aligned}$$

As described above, since M is the value of the ratio between the respective emitter areas of the transistors Q7 and Q6, the output current Iout of the temperature compensation circuit 1*a* can be given by following expressions under the above condition:

$$\begin{aligned} Iout &= I1 \\ &= M\cdot I3 \\ &= M\cdot(A1+B1\cdot T)/R2 \\ &= M\cdot b2\cdot Vbg1/Rref2 \end{aligned}$$

and the current is constant independently of the temperature. As an example, assuming that N=10, Vbg1=1.2V, d1=2 mV/K, and c2=2000 ppm/° C., a≈0.2 mV/K can be given, and thus, by setting each resistance value of the resistors R1, R3, R4 and R5 as:

$$b1/b2=(d1+c2\cdot Vbg1)/a=22$$

the output current Iout becomes constant independently of the temperature. As another example, further assuming that M=1, b2=10, and Rref2=100Ω, by setting each resistance value of the resistors r1 and R5 as:

$$b1=22\times b2=220$$

the output current Iout can be given by:

$$Iout=M\cdot b2\cdot Vbg1/Rref2=120\text{ mA}$$

and the current is constant independently of the temperature.

As described above, the temperature compensation circuit 1*a* according to an embodiment of the present invention can output the constant current Iout independently of the temperature. In an embodiment according to the present invention, the output current Iout of the temperature compensation circuit 1*a* is a source current.

Second Embodiment

There will hereinafter be described a configuration of a constant current circuit according to a second embodiment of the present invention referring to FIG. 2.

Figure 2:
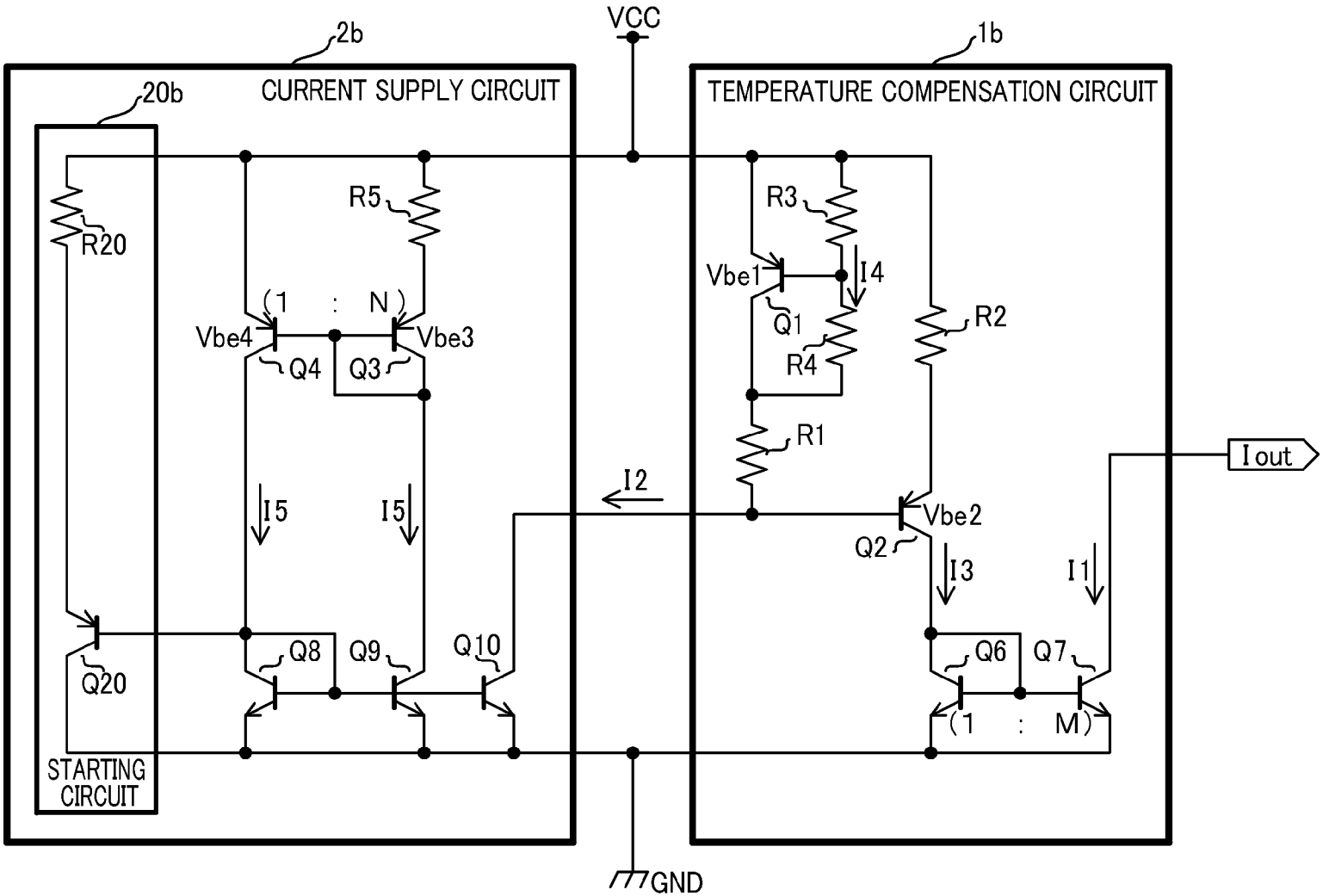
FIG. 2 is a circuit block diagram illustrating a configuration of a constant current circuit according to a second embodiment of the present invention.

The constant current circuit shown in FIG. 2 includes a current supply circuit 2*b* and a temperature compensation circuit 1*b* and has such a configuration that a polarity of the constant current circuit according to a first embodiment of the present invention is reversed.

More specifically, the current supply circuit 2*b* includes: transistors Q3, Q4, which are PNP bipolar transistors; transistors Q8, Q9, Q10, which are NPN bipolar transistors; a resistor R5; and a starting circuit 20*b* including a transistor Q20, which is a PNP bipolar transistor, and a resistor R20, for example. The temperature compensation circuit 1*b* according to an embodiment of the present invention includes: transistors Q1, Q2, which are PNP bipolar transistors; transistors Q6, Q7, which are NPN bipolar transistors; and resistors R1, R2, R3, R4, for example. The transistors Q1, Q4 and the resistors R2, R3, R5, R20 are connected to a power-supply potential VCC, while the transistor Q6 to Q10 and Q20 are connected to a ground potential, respectively.

By having a configuration as above, the temperature compensation circuit 1*b* according to an embodiment of the present invention can output the constant current Iout independently of the temperature similarly to the temperature compensation circuit 1*a* according to a first embodiment of the present invention. In an embodiment according to the present invention, the output current I2 of the current supply circuit 2*b* and the output current Iout of the temperature compensation circuit 1*b* are sink currents.

Third Embodiment

There will hereinafter be described a configuration of a constant current circuit according to a third embodiment of the present invention referring to FIG. 3.

Figure 3:
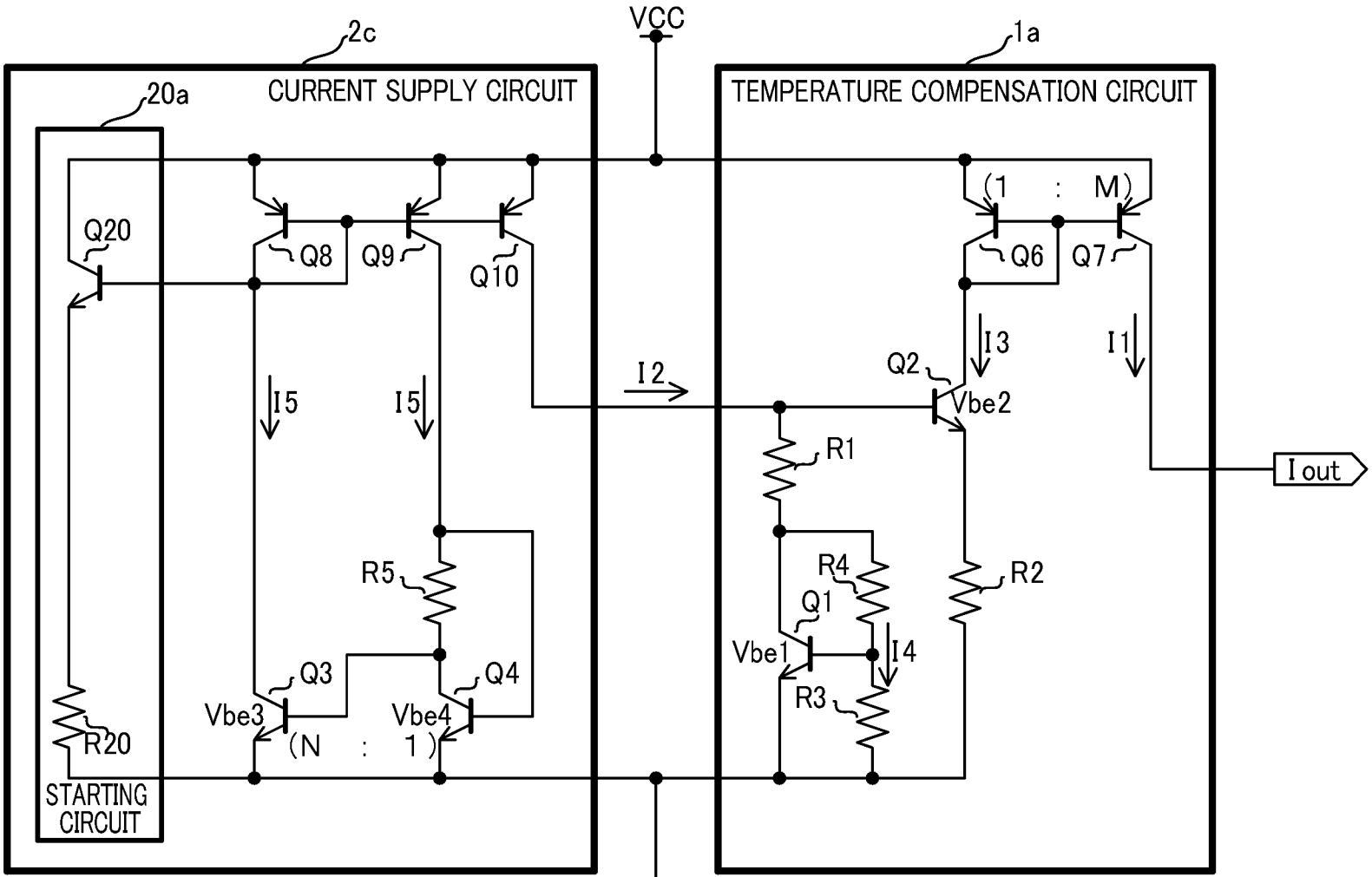
FIG. 3 is a circuit block diagram illustrating a configuration of a constant current circuit according to a third embodiment of the present invention.

In the constant current circuit shown in FIG. 3, the current supply circuit 2*a* of the first embodiment is a current supply circuit 2*c*.

The current supply circuit 2*c* includes: transistors Q3, Q4, which are NPN bipolar transistors; transistors Q8, Q9, Q10, which are PNP bipolar transistors; a resistor R5; and a starting circuit 20*a* including a transistor Q20, which is an NPN bipolar transistor, and a resistor R20, for example. The diode-connected transistor Q8 and the third transistor Q3 have collectors connected to each other, and emitters are connected to a power-supply potential VCC and a ground potential, respectively. The transistor Q9, which constitutes a current mirror circuit together with the transistor Q8, and the fourth transistor Q4 have collectors thereof connected through the fifth resistor R5, and emitters thereof connected to the power-supply potential VCC and the ground potential, respectively. The base of the transistor Q3 is connected to a connection point between the resistor R5 and the collector of the transistor Q4, the base of the transistor Q4 is connected to a connection point between the collector of the transistor Q9 and the resistor R5, and N is a value of a ratio between respective emitter areas of the transistors Q3 and Q4. Moreover, the transistor Q10 constituting the current mirror circuit together with the transistor Q8 has an emitter connected to the power-supply potential VCC, and a collector current is output as a second current I2 from the current supply circuit 2*c*. The transistor Q20 of the starting circuit 20*a* has a collector connected to the power-supply potential VCC, an emitter connected to the ground potential through the resistor R20, and a base connected to the base of the transistor Q8, respectively.

Subsequently, there will be described an operation of the constant current circuit according to an embodiment of the present invention.

In the current supply circuit 2*c*, assuming that a base-emitter voltage of the transistor Q3 and a base-emitter voltage of the transistor Q4 are Vbe3 and Vbe4, respectively, a voltage across the resistor R5 is Vbe4−Vbe3, and thus, a collector current I5 of the transistors Q8 to Q10 constituting a current mirror circuit can be expressed as:

$$I5=(Vbe4-Vbe3)/R5$$

As described above, since N is the value of the between the respective emitter areas of the transistors Q3 and Q4, when a calculation is made as in the case with a first embodiment according to the present invention, the output current I2 of the current supply circuit 2*c* and a voltage VR1 across the resistor R1 of the temperature compensation circuit 1*a* can respectively be expressed as:

$$I2=I5=(a/R5)\cdot T,$$

$$VR1=I2\cdot R1=a\cdot b1\cdot T$$

According to an embodiment of the present invention, the output current I2 of the current supply circuit 2*c* is a source current.

As described above, the current supply circuit 2*c* according to an embodiment of the present invention supplies the current I2 to the temperature compensation circuit 1*a* and generates the voltage VR1 across the resistor R1 varying substantially in proportion to the temperature T as in the case with a first embodiment of the present invention. Therefore, the temperature compensation circuit 1*a* can output a constant current Iout independently of the temperature. As in the case with a second embodiment of the present invention, by employing a current supply circuit with the reversed polarity as the current supply circuit 2*c*, the temperature compensation circuit 1*b* can be employed instead of the temperature compensation circuit 1*a*.

Fourth Embodiment

There will hereinafter be described a configuration of a constant current circuit according to a fourth embodiment of the present invention referring to FIG. 4.

Figure 4:
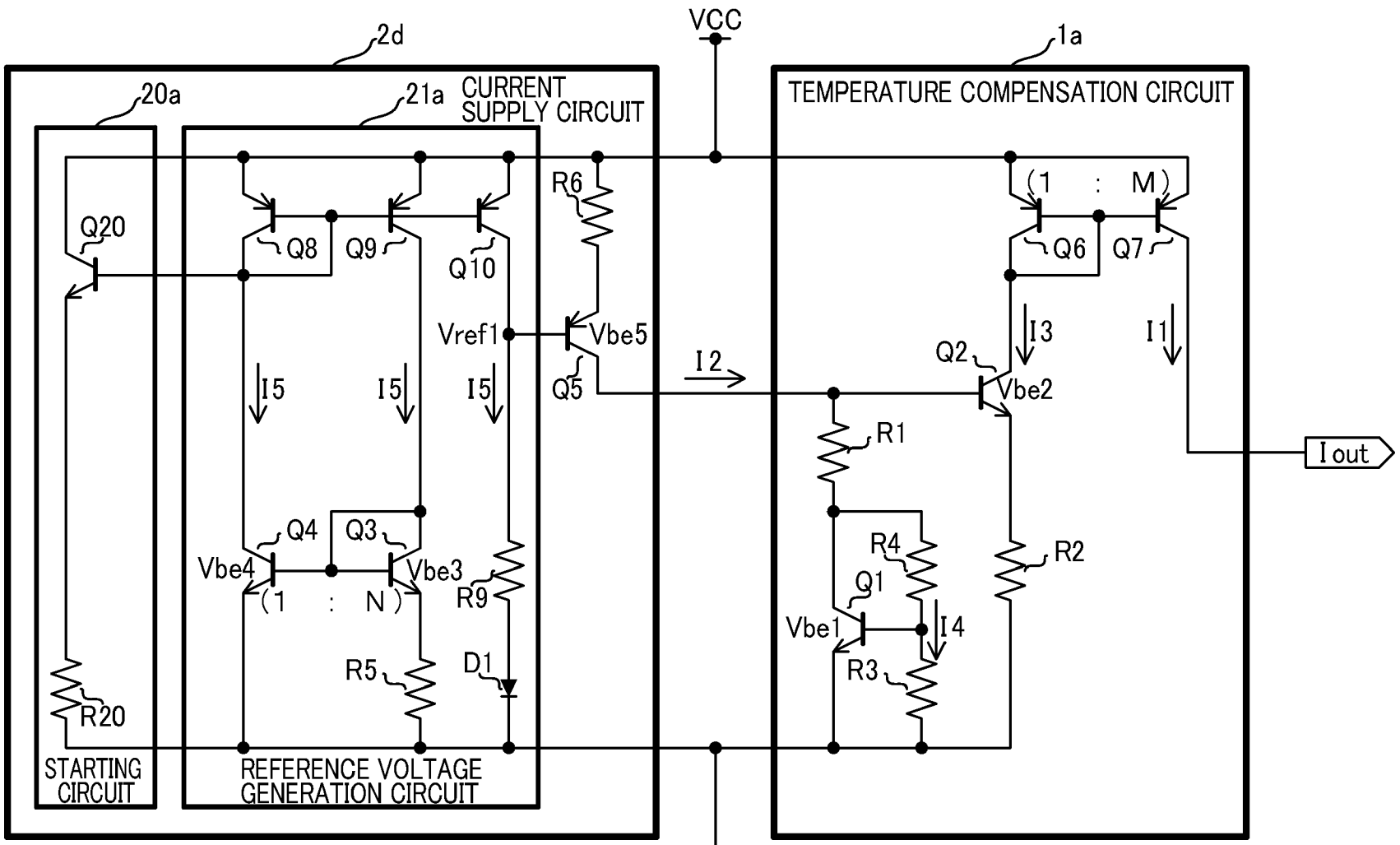
FIG. 4 is a circuit block diagram illustrating a configuration of a constant current circuit according to a fourth embodiment of the present invention.

In the constant current circuit shown in FIG. 4, a current supply circuit 2*d* is employed in place of the current supply circuit 2*a* according to a first embodiment of the present invention.

The current supply circuit 2*d* includes: a reference voltage generation circuit 21*a*; a starting circuit 20*a*; a transistor Q5, which is a PNP bipolar transistor; and a resistor R6, for example. The reference voltage generation circuit 21*a* and the starting circuit 20*a* are configured, by adding a diode D1 having a cathode connected to a ground potential and a resistor R9 having one end connected to the collector of the transistor Q10 and the other end connected to an anode of the diode D1, to the current supply circuit 2*a* according to a first embodiment of the present invention, so that a configuration thereof becomes similar to that shown in FIG. 3 of the Japanese Patent Laid-Open Publication No. Hei8-339232. A voltage of a connection point between the collector of the transistor Q10 and the resistor R9 is an output voltage Vref1 of the reference voltage generation circuit 21*a*. The fifth transistor Q5 has an emitter connected to a power-supply potential VCC through the sixth resistor R6, a base connected to an output of the reference voltage generation circuit 21*a*, and a collector current is output as a second current I2 from the current supply circuit 2*d*.

Subsequently, there will be described an operation of the constant current circuit according to an embodiment of the present invention.

In the current supply circuit 2*d*, as described above, the output voltage Vref1 of the reference voltage generation circuit 21*a* becomes constant independently of temperature, by making a positive temperature coefficient of a voltage VR9 across the resistor R9 equal to an absolute value of a negative temperature coefficient of a forward drop voltage VD of the diode D1. Moreover, assuming that the output voltage of the reference voltage generation circuit 21*a* relative to the power-supply potential VCC is −Vref2 (=Vref1−VCC), and a base-emitter voltage of the transistor Q5 is Vbe5, a voltage across the resistor R6 is Vref2−Vbe5, and the output current I2 of the current supply circuit 2*d* can be given by:

$$I2=(Vref2-Vbe5)/R6$$

Furthermore, assuming that a bandgap voltage at 0 K of the pn junction of the transistor Q5 is Vbg5 and the temperature coefficient is −d5, the base-emitter voltage Vbe5 is given by:

$$Vbe5=Vbg5-d5\cdot T$$

Therefore, using a constant Vref0 independent of temperature T, which is:

$$Vref0=Vref2-Vbg5$$

the output current I2 of the current supply circuit 2*d* can be expressed as:

$$I2 = [Vref2 - (Vbg5 - d5 \cdot T)] / R6$$
$$= (Vref0 + d5 \cdot T) / R6$$

In an embodiment according to the present invention, the output current I2 of the current supply circuit 2*d* is a source current.

In a temperature compensation circuit 1*a*, a voltage VR1 across a resistor R1 can be expressed, using a value b3(=R1/R6) of a resistance value ratio of the resistors R1 and R6, as follows:

$$VR1 = I2 \cdot R1$$
$$= (R1 / R6) \cdot (Vref0 + d5 \cdot T)$$
$$= b3 \cdot (Vref0 + d5 \cdot T)$$

Here, assuming that the resistors R1 and R6 have substantially equal temperature coefficient, the value b3 of the resistance value ratio is a constant independent of the temperature T. Therefore, the voltage VR1 is a voltage that can be expressed by a linear function of the temperature T, that is, a voltage varying substantially in proportion to the temperature T. When a calculation is made as in the case with a first embodiment of the present invention, the voltage VR2 across the resistor R2 can be expressed, using such constants A2 and B2 independent of the temperature T as given by:

$$A2=b3 \cdot Vref0+b2 \cdot Vbg1,$$
$$B2=b3 \cdot d5-b2 \cdot d1$$

as a linear function of the temperature T that can be expressed as:

$$VR2 = VR1 + VR4$$
$$= b3 \cdot (Vref0 + d5 \cdot T) + b2 \cdot (Vbg1 - d1 \cdot T)$$
$$= A2 + B2 \cdot T$$

Moreover, as in the case with a first embodiment of the present invention, by differentiating a collector current I3 of a transistor Q6 with respect to the temperature T, the following expressions can be obtained:

$$\partial I3 / \partial T = (1 / R2^2) \cdot (R2 \cdot B2 - Rref2 \cdot c2 \cdot VR2)$$
$$= (Rref2 / R2^2) \cdot (B2 - c2 \cdot A2)$$

Therefore, the collector current I3 is constant independently of the temperature under a condition of:

$$B2 - c2 \cdot A2 = (d5 - c2 \cdot Vref0) \cdot b3 - (d1 + c2 \cdot Vbg1) \cdot b2$$
$$= 0$$

As described above, since M is a value of a ratio between respective emitter areas of transistor Q7 and the transistor Q6, an output current Iout of the temperature compensation circuit 1*a* can be given by following expressions under the above condition:

$$Iout = I1$$
$$= M \cdot I3$$
$$= M \cdot (A2 + B2 \cdot T) / R2$$
$$= M \cdot b2 \cdot (d5 \cdot Vbg1 + d1 \cdot Vref0) / [Rref2 \cdot (d5 - c2 \cdot Vref0)]$$

and the current is constant independently of the temperature. As an example, assuming that VCC=3V, Vref1=1.8V, Vbg1=Vbg5=1.2V, d1=d5=2 mV/K and c2=2000 ppm/° C., Vref0=0V can be given, and thus, by setting each resistance value of the resistors R1, R3, R4, and R6 as:

$$b3/b2=(d1+c2 \cdot Vbg1)/d5=2.2$$

the output current Iout becomes constant independently of the temperature. As another example, further assuming that M=1, b2=10, and Rref2=100Ω, by setting each resistance value of the resistors R1 and R6 as follows:

$$b3=2.2 \times b2=22$$

the output current Iout can be given an expression as follows:

$$Iout=M \cdot b2 \cdot Vbg1/Rref2=120 \text{ mA}$$

and the current is constant independently of the temperature.

As described above, the temperature compensation circuit 1*a* according to an embodiment of the present invention can output the constant current Iout independently of the temperature.

Fifth Embodiment

There will hereinafter be described a configuration of a constant current circuit according to a fifth embodiment of the present invention referring to FIG. 5.

Figure 5:
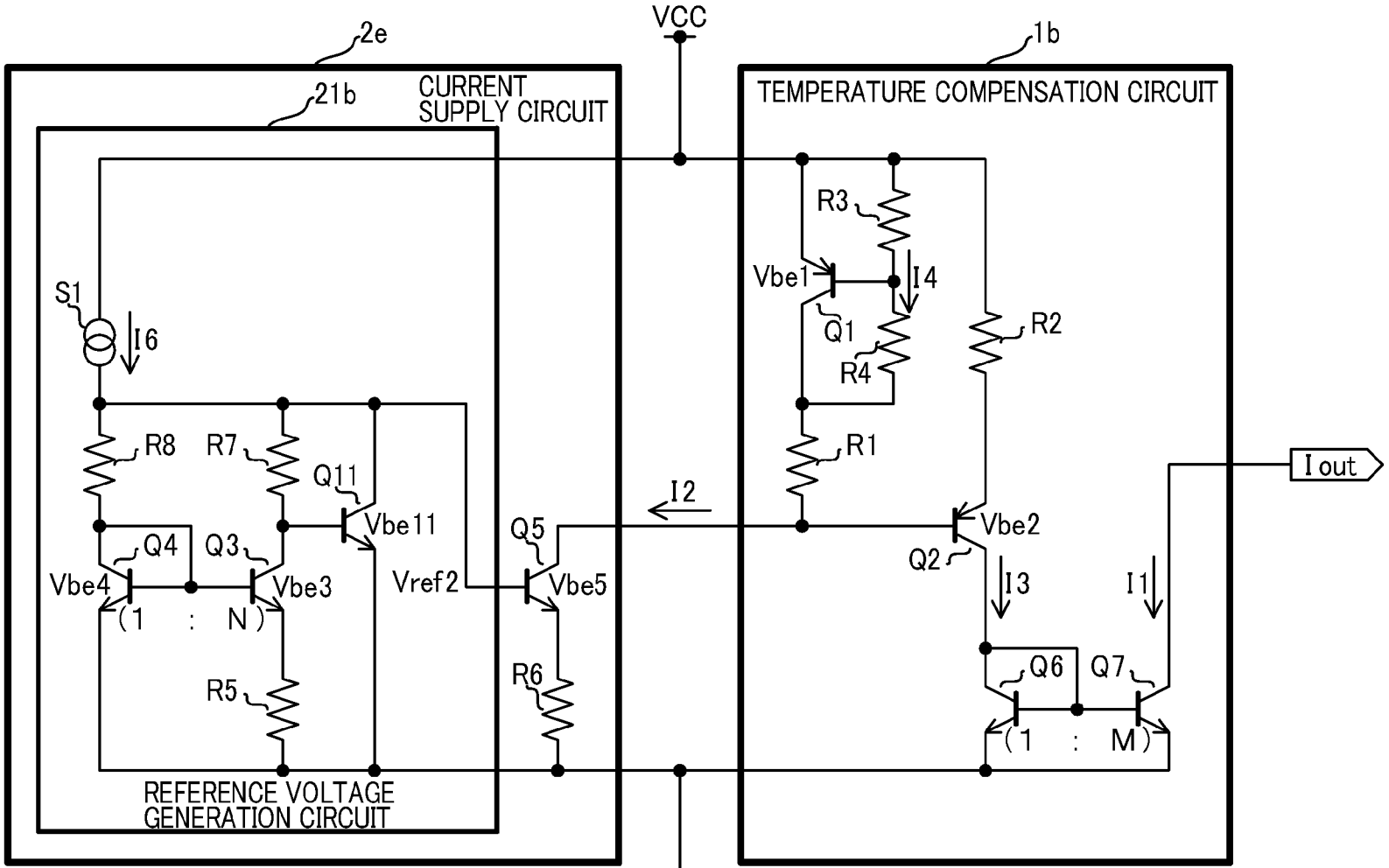
FIG. 5 is a circuit block diagram illustrating a configuration of a constant current circuit according to a fifth embodiment of the present invention.
Figure 6:
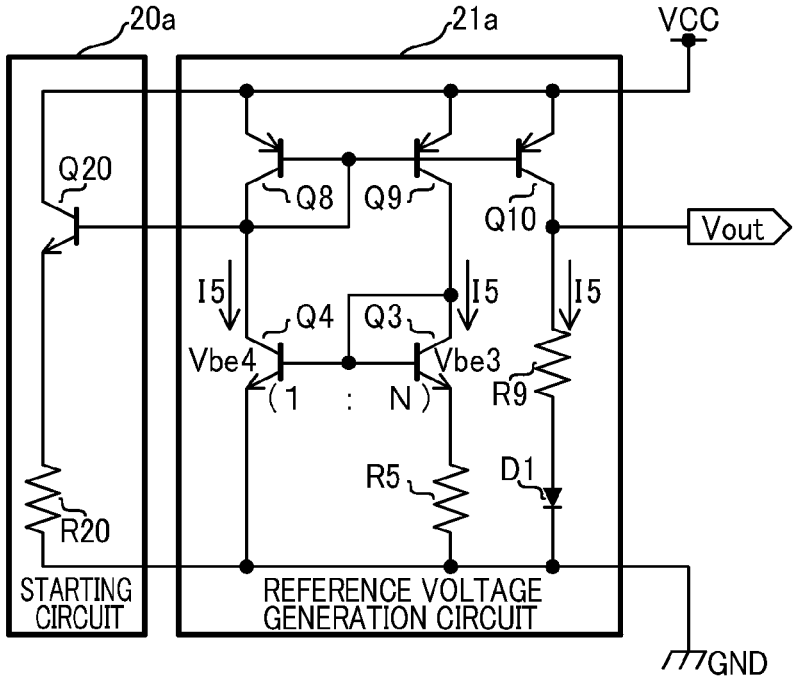
FIG. 6 is a circuit block diagram illustrating an example of a configuration of a general reference voltage generation circuit.
Figure 7:
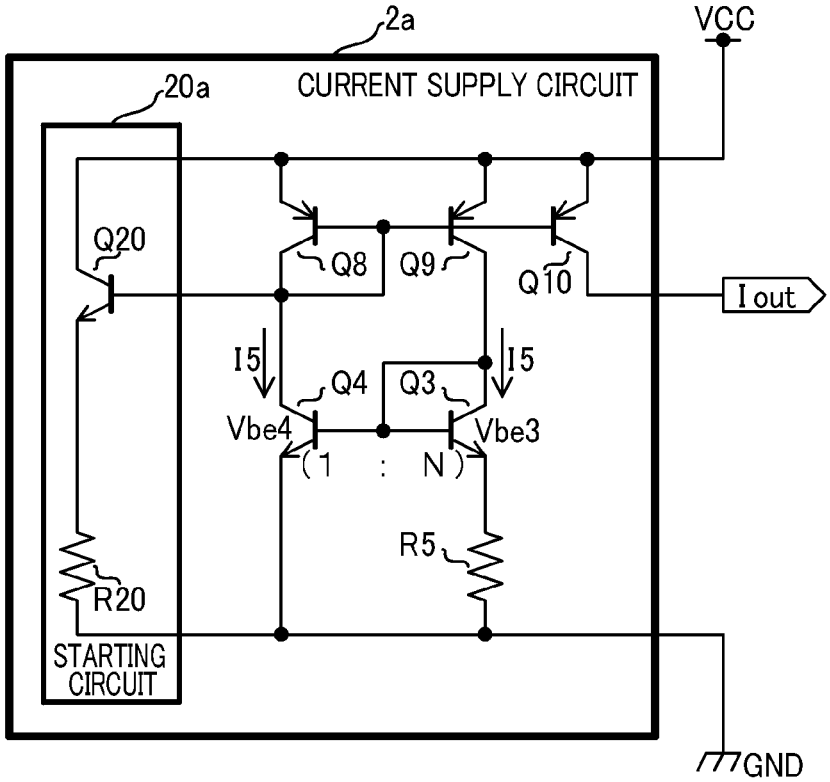
FIG. 7 is a circuit block diagram illustrating an example of a configuration of a general current supply circuit.

In the constant current circuit shown in FIG. 5, a current supply circuit 2*e* is employed in place of the current supply circuit 2*b* according to a second embodiment of the present invention.

The current supply circuit 2*e* includes: a reference voltage generation circuit 21*b*; a transistor Q5, which is an NPN bipolar transistor; and a resistor R6, for example. The reference voltage generation circuit 21*b* includes: the transistors Q3, Q4, Q11, which are NPN bipolar transistors; the resistors R5, R7, R8, and a current source S1, for example, and has a configuration similar to that shown in FIG. 4 of Japanese Patent Laid-Open Publication No. Hei8-339232. The diode-connected transistor Q4 has a collector supplied with a current through the resistor R8 from the current source S1 having one end connected to a power-supply potential VCC, and has an emitter connected to a ground potential. The transistor Q3 has a collector supplied with a current from the current source S1 through the resistor R7, an emitter connected to the ground potential through the resistor R5, and a base connected to the base of the transistor Q4, respectively. The transistor Q11 has a collector supplied with a current from the current source S1, an emitter connected to the ground potential, and a base connected to a connection point between the resistor R7 and the collector of the transistor Q3, respectively. A voltage at connection point between the resistors R8, R7 and the collector of the transistor Q11 is an output voltage Vref2 of the reference voltage generation circuit 21*b*. The fifth transistor Q5 has an emitter connected to the ground potential through the sixth resistor R6, a base connected to the output of the reference voltage generation circuit 21*b*, and a collector current is output as a second current I2 from the current supply circuit 2*e*.

Subsequently, there will be described an operation of the constant current circuit according to an embodiment of the present invention.

In the current supply circuit 2*e*, assuming that a voltage across the resistor R7 of the reference voltage generation circuit 21*b* is VR7 and a base-emitter voltage of the transistor Q11 is Vbe11, the output voltage vref2 of the reference voltage generation circuit 21*b* is given by an expression:

$$Vref2=VR7+Vbe11,$$

and by making a positive temperature coefficient of the voltage VR7 equal to an absolute value of a negative temperature coefficient of a base-emitter voltage Vbe11, the output voltage becomes constant independently of temperature similarly to the output voltage Vref1 of the current supply circuit 2*d* according to a fourth embodiment of the present invention. Assuming that a base-emitter voltage of the transistor Q5 is Vbe5, a voltage across the resistor R6 is vref2−Vbe5, and the output current I2 of the current supply circuit 2*e* can be expressed by an equation:

$$I2=(Vref2-Vbe5)/R6$$

Therefore, when a calculation is made as in the case with a fourth embodiment according to the present invention, the output current I2 of the current supply circuit 2*e* and a voltage VR1 across a resistor R1 in the temperature compensation circuit 1*b* can be expressed, respectively, as:

$$I2=(Vref0+d5\cdot T)/R6,$$

$$VR1=I2\cdot R1=b3\cdot(Vref0+d5\cdot T)$$

According to an embodiment of the present invention, the output current I2 of the current supply circuit 2*e* is a sink current.

As described above, the current supply circuit 2*e* according to an embodiment of the present invention supplies the current I2 to the temperature compensation circuit 1*b*, and generates the voltage VR1 across the resistor R1, which varies substantially in proportion to the temperature T (expressed as a linear function of the temperature T,) as in the case with a fourth embodiment. Therefore the temperature compensation circuit 1*b* can output a constant current Iout independently of the temperature.

As described above, in the temperature compensation circuits 1*a* and 1*b*, one end of the resistor R1 is connected to the collector of the transistor Q1 and the other end thereof is connected to the base of the transistor Q2, one end of the resistor R2 is connected to the emitter of the transistor Q1 and the other end thereof is connected to the emitter of the transistor Q2, the base-emitter voltages of the transistors Q1 and Q2 of the same conductivity type are made substantially equal, a ratio between the base-emitter voltage of the transistor Q1 and the base-emitter voltage thereof are made a predetermined ratio, and the current I2 for generating the voltage VR1 across the resistor R1, which voltage varies substantially in proportion to the temperature, is supplied to the connection point between the base of the transistor Q2 and the resistor R1, and thus, the temperature-compensated current I1 (Iout) can be output according to the collector current I3 of the transistor Q2.

Moreover, one end of the resistor R3 is connected to the base of the transistor Q1 and the other end thereof is connected to the emitter thereof, and one end of the resistor R4, which has a substantially temperature coefficient equal to that of the resistor R3, is connected to the base of the transistor Q1 and the other end thereof is connected to the collector thereof, and thus, a ratio between the base-emitter voltage and the base-emitter voltage of the transistor Q1 can be made constant independently of the temperature.

Furthermore, as shown in FIGS. 1 to 3, a differential voltage between the base-emitter voltages of the transistors Q3 and Q4, which have the emitter areas different from each other, is applied to both ends of the resistor R5 having a temperature coefficient substantially equal to that of the resistor R1, and the current I2 is supplied to the temperature compensation circuit 1*a* or 1*b* according to the current I5 flowing through the resistor R5, and thus, the voltage VR1 across the resistor R1, which varies substantially in proportion to the temperature, can be generated.

Furthermore, as shown in FIGS. 4 and 5, an emitter current of the transistor Q5, which have the base applied with the temperature-compensated reference voltage, flows through the resistor R6 having the temperature coefficient substantially equal to that of the resistor R1, and the collector current of the transistor Q5 is supplied to the temperature compensation circuit 1*a* or 1*b* as the current I2, and thus, the voltage VR1 across the resistor R1, which varies substantially in proportion to the temperature can be generated.

In first to third embodiments of the present invention, the current supply circuits 2*a* to 2*c* are shown in FIGS. 1 to 3, as a configuration example of a current supply circuit, in which the current I2 is supplied to the temperature compensation circuit 1*a* or 1*b* to generate the voltage VR1 across the resistor R1 which varies substantially in proportion to the temperature, however these are not limitative. Even in a current supply circuit with another configuration, if a differential voltage between base-emitter voltages of a pair of transistors having emitter areas different from each other, is applied to both ends of a resistor having a temperature coefficient substantially equal to that of the resistor R1, and the current I2 is supplied according to a current flowing through the resistor, the voltage VR1 across the resistor R1 becomes a voltage varying substantially in proportion to the temperature. A current supply circuit for supplying the current I2 can be changed as appropriate, to have a configuration with reversed polarity such as the current supply circuits 2*a* and 2*b*, so that a source current is supplied as the current I2 when the temperature compensation circuit 1*a* is employed, and a sink current is supplied as the current I2 when the temperature compensation circuit 1*b* is employed.

In fourth and fifth embodiments of the present invention, the current supply circuits 2*d* and 2*e* are shown in FIGS. 4 and 5, as a configuration example of a current supply circuit, in which the current I2 is supplied to the temperature compensation circuit 1*a* or 1*b* to generate the voltage VR1 across the resistor R1 which varies substantially in proportion to the temperature, however these are not limitative. Even in a current supply circuit with another configuration, if an emitter current of a transistor, which have a base applied with a temperature-compensated reference voltage, flows through a resistor having the temperature coefficient substantially equal to that of the resistor R1, and the collector current of the transistor is supplied as the current I2, the voltage VR1 across the resistor R1 becomes a voltage (expressed as a linear function of the temperature) varying substantially in proportion to the temperature. The current supply circuit for supplying the current I2 can be changed as appropriate, to have such a configuration that the polarity of the transistor Q5 and the resistor R6 is reversed, such as the current supply circuits 2*d* and 2*e*, so that a source current is supplied as the current I2 when the temperature compensation circuit 1*a* is employed, and a sink current is supplied as the current I2 when the temperature compensation circuit 1*b* is employed. A reference voltage generation circuit for generating a temperature-compensated reference voltage is not limited to those including band-gap circuits as shown as examples in FIGS. 4 and 5.

In the above embodiments, any of the transistors is a bipolar transistor, but this is not limitative. For example, a bipolar transistor is employed only for either of the PNP type or NPN type and an MOS (Metal-Oxide Semiconductor) transistor is employed for the others, so that a CMOS (Complementary MOS) process can be used when a constant current circuit according to an embodiment of the present invention is configured as an integrated circuit. More specifically, as an example, when a P-channel MOS transistor is employed for the transistors Q6 to Q10 in a constant current circuit shown in FIG. 1, a substrate-type NPN bipolar transistor including: a n-type semiconductor substrate that serves as a collector; a p-type well layer formed on the n-type semiconductor substrate together with a p-type diffusion layer further formed on the p-type well layer that serve as base; and an n-type diffusion layer formed on the p-type well layer that serves as an emitter, can be formed concurrently with an MOS transistor in the CMOS process, for example.

The above embodiments of the present invention are simply for facilitating the understanding of the present invention and are not in anyway to be construed as limiting the present invention. The present invention may variously be changed or altered without departing from its spirit and encompass equivalents thereof.

What is claimed is:

1. A constant current circuit comprising:

a temperature compensation circuit configured to output a first current which is temperature-compensated; and a current supply circuit configured to supply a second current to the temperature compensation circuit, the temperature compensation circuit including:

a voltage multiplication circuit including a first transistor configured to generate a base-collector voltage obtained by multiplying a base-emitter voltage by a predetermined ratio;

a second transistor identical in conductivity type and substantially equal in base-emitter voltage to the first transistor;

a first resistor having one end connected to a collector of the first transistor and the other end connected to a base of the second transistor; and a second resistor having one end connected to an emitter of the first transistor and the other end connected to an emitter of the second transistor, the first current being output according to a collector current of the second transistor, and the second current being supplied to a connection point between the base of the second transistor and the first resistor, to generate between both ends of the first resistor a voltage varying substantially in proportion to temperature, the current supply circuit including:

a third transistor and a fourth transistor whose emitter areas are different from each other; and a fifth resistor whose temperature coefficient is substantially equal to a temperature coefficient of the first resistor, the fifth resistor having both ends applied with a differential voltage between a base-emitter voltage of the third transistor and a base-emitter voltage of the fourth transistor, wherein the second current is supplied according to a current flowing through the fifth resistor.

2. A constant current circuit comprising:

a temperature compensation circuit configured to output a first current which is temperature-compensated; and a current supply circuit configured to supply a second current to the temperature compensation circuit, the temperature compensation circuit including:

a voltage multiplication circuit including a first transistor configured to generate a base-collector voltage obtained by multiplying a base-emitter voltage by a predetermined ratio;

a second transistor identical in conductivity type and substantially equal in base-emitter voltage to the first transistor;

a first resistor having one end connected to a collector of the first transistor and the other end connected to a base of the second transistor; and a second resistor having one end connected to an emitter of the first transistor and the other end connected to an emitter of the second transistor;

the first current being output according to a collector current of the second transistor; and the second current being supplied to a connection point between the base of the second transistor and the first resistor, to generate between both ends of the first resistor a voltage varying substantially in proportion to temperature, the voltage multiplication circuit including:

a third resistor having one end connected to a base of the first transistor and the other end connected to the collector of the first transistor; and a fourth resistor whose temperature coefficient is substantially equal to a temperature coefficient of the third resistor, the fourth resistor having one end connected to the base of the first transistor and the other end connected to the emitter of the first transistor, the current supply circuit including:

a third transistor and a fourth transistor whose emitter areas are different from each other; and a fifth resistor whose temperature coefficient is substantially equal to a temperature coefficient of the first resistor, the fifth resistor having both ends applied with a differential voltage between a base-emitter voltage of the third transistor and a base-emitter voltage of the fourth transistor, wherein the second current is supplied according to a current flowing through the fifth resistor.

3. A constant current circuit comprising:

a temperature compensation circuit configured to output a first current which is temperature-compensated; and a current supply circuit configured to supply a second current to the temperature compensation circuit, the temperature compensation circuit including:

a voltage multiplication circuit including a first transistor configured to generate a base-collector voltage obtained by multiplying a base-emitter voltage by a predetermined ratio;

a second transistor identical in conductivity type and substantially equal in base-emitter voltage to the first transistor;

a first resistor having one end connected to a collector of the first transistor and the other end connected to a base of the second transistor; and a second resistor having one end connected to an emitter of the first transistor and the other end connected to an emitter of the second transistor, the first current being output according to a collector current of the second transistor, and the second current being supplied to a connection point between the base of the second transistor and the first resistor, to generate between both ends of the first resistor a voltage varying substantially in proportion to temperature, the current supply circuit including:

a reference voltage generation circuit configured to generate a predetermined temperature-compensated reference voltage;

a fifth transistor having a base applied with the reference voltage; and a sixth resistor whose temperature coefficient is substantially equal to a temperature coefficient of the first resistor, and through which an emitter current of the fifth transistor flows, wherein the second current is a collector current of the fifth transistor.

4. A constant current circuit comprising:

a temperature compensation circuit configured to output a first current which is temperature-compensated; and a current supply circuit configured to supply a second current to the temperature compensation circuit, the temperature compensation circuit including:

a voltage multiplication circuit including a first transistor configured to generate a base-collector voltage obtained by multiplying a base-emitter voltage by a predetermined ratio;

a second transistor identical in conductivity type and substantially equal in base-emitter voltage to the first transistor;

a first resistor having one end connected to a collector of the first transistor and the other end connected to a base of the second transistor; and a second resistor having one end connected to an emitter of the first transistor and the other end connected to an emitter of the second transistor, the first current being output according to a collector current of the second transistor, and the second current being supplied to a connection point between the base of the second transistor and the first resistor, to generate between both ends of the first resistor a voltage varying substantially in proportion to temperature, the voltage multiplication circuit including:

a third resistor having one end connected to a base of the first transistor and the other end connected to the collector of the first transistor; and a fourth resistor whose temperature coefficient is substantially equal to a temperature coefficient of the third resistor, the fourth resistor having one end connected to the base of the first transistor and the other end connected to the emitter of the first transistor, the current supply circuit including:

a reference voltage generation circuit configured to generate a predetermined temperature-compensated reference voltage;

a fifth transistor having a base applied with the reference voltage; and a sixth resistor whose temperature coefficient is substantially equal to a temperature coefficient of the first resistor, and through which an emitter current of the fifth transistor flows, wherein the second current is a collector current of the fifth transistor.

* * * * *

UNITED STATES PATENT AND TRADEMARK OFFICE

CERTIFICATE OF CORRECTION

PATENT NO. : 7,944,272 B2
APPLICATION NO. : 12/568916
DATED : May 17, 2011
INVENTOR(S) : Nishi It is certified that error appears in the above-identified patent and that said Letters Patent is hereby corrected as shown below:

Column 5, line 28: replace --B1= a times b1b2 times d1-- with "B1=a·b1-b2·d1"

Signed and Sealed this
Twenty-third Day of August, 2011

David J. Kappos

David J. Kappos
*Director of the United States Patent and Trademark Office*